United States Patent [19]

Leiter et al.

[11] Patent Number: 4,676,039

[45] Date of Patent: Jun. 30, 1987

[54] QUICK ASSEMBLY AND KNOCKDOWN BUILDING STRUCTURE

[76] Inventors: Gittle Leiter, 1443-50th St., Brooklyn, N.Y. 11219; Timothy P. Mahon, 387 School St., Woodbridge, N.J. 07095

[21] Appl. No.: 819,926

[22] Filed: Jan. 17, 1986

[51] Int. Cl.[4] ..... E04B 1/00

[52] U.S. Cl. ..... 52/282; 52/270; 52/588

[58] Field of Search ..... 52/588, 282, 284, 270, 52/822, 823, 825

[56] References Cited

U.S. PATENT DOCUMENTS

| | | | |
|---|---|---|---|
| 2,074,442 | 3/1937 | Venzie | 52/588 |
| 2,399,169 | 4/1946 | Crawford | 52/823 |
| 2,543,122 | 2/1951 | Mortenson | 52/588 |
| 3,043,407 | 7/1962 | Marryatt | 52/588 |
| 3,046,852 | 7/1962 | Graham | 52/588 |
| 3,055,461 | 9/1962 | De Ridder | 52/588 |
| 3,111,203 | 11/1963 | De Ridder | 52/588 |
| 3,116,950 | 1/1964 | Chieger | 52/588 |
| 3,253,371 | 5/1966 | Honrold | 52/588 |
| 3,352,073 | 11/1967 | Hipple | 52/822 |
| 3,376,679 | 4/1968 | Gregoire | 52/282 |
| 3,499,254 | 3/1970 | Jefferys | 52/538 |
| 3,568,388 | 3/1971 | Flachbarth | 52/588 |
| 4,229,905 | 10/1980 | Rush | 52/207 |
| 4,494,354 | 1/1985 | Johnston | 52/823 |

FOREIGN PATENT DOCUMENTS

| | | | |
|---|---|---|---|
| 2153394 | 5/1973 | Fed. Rep. of Germany | 52/730 |
| 2159852 | 12/1985 | United Kingdom | 52/239 |

*Primary Examiner*—Henry E. Raduazo
*Attorney, Agent, or Firm*—Helfgott & Karas

[57] ABSTRACT

A quick assembly and knockdown building structure formed of wall panels and corner posts. Each of the wall panels and corner posts have a male interlocking member on one side thereof and a female interlocking member at the other side thereof. The wall panels can be interconnected one to the other and can be interconnected to the corner posts to form a corner of the structure. The assembly can be made without the need of any tools or fasteners.

13 Claims, 16 Drawing Figures

QUICK ASSEMBLY AND KNOCKDOWN BUILDING STRUCTURE

BACKGROUND OF THE INVENTION

This invention relates to building structures, and more particularly to a building structure that permits quick assembly and knockdown without the need of tools.

Building structures frequently require that they be quickly assembled and that they permit quick knockdown of the completed structure. Furthermore, such assembly and knockdown must be achieved by a user himself without the need of skilled labor or professional assistance. As such, not only is the ease of assembly important, but also the ability to erect and knockdown the structure without tools or complex equipment.

One such typical requirement for a quick assembly and knockdown building structure is in connection with the erection of a SUKKAH. The Bible commands that during the fall season a small hut or tabernacle, referred to as a Sukkah, be erected to commemorate the temporary dwelling places that were used by the Children of Israel during their travels through the desert. The Sukkah must be erected and utilized for eight days and is then generally disassembled and stored until the following year. Although the roof of the Sukkah is made of material that grows and has been cut, such as bamboo sticks, twigs, branches and the like, the walls can be constructed of any material and generally must be of a sturdy enough nature to withstand normal environmental conditions.

Many types of construction and materials have been utilized for the Sukkah. In some instances, the walls are made of wood and a substantially firm construction is used. However, this requires carpentry and the need for skilled workmen. The use of pole frame connected by fittings has been also attempted, with plastic or canvas materials strapped around the pole frame. This type of construction takes less time than erecting a wood structure, however, it does not provide adequate protection from the environment and is subject to blowing away in wind and heavy storm.

The use of aluminum or vinyl wall panels has also been suggested. However, in such cases the complexity arises in connecting these panels. Typically, nuts and bolts, or complex clamping arrangements are utilized to interconnect them. This then requires the need for tools, skilled labor, and generally a lot of time to erect and disassemble.

In addition to the use as a Sukkah, there is often needed other types of building structures which are easily erected and easily knocked down. For example, individuals may require a temporary storage room for tools and machinery. In the construction industry, it is typical to erect temporary structures at a building site to house various tools, supplies, and machinery. In addition, temporary office space may be needed at a construction site, and it may be desired to provide a structure which can be easily assembled and disassembled without the need for spending considerable time, cost, or labor in such construction.

Additional uses of a temporary building structure include providing an enclosed porch during the summer time in warm areas where the individuals can enjoy the outdoors. Construction of a temporary building may be needed during hikes, and even for travelers who wish to erect a structure which can be used as they travel cross country over long periods of time.

These are but a few of the situations where temporary building structures are needed. In each case, the same requirements and demands must be met. Specifically, it must be easily erected, sufficiently strong to withstand environmental conditions, provide simple storage, be lightweight, and generally permit construction without the need of skilled labor. This last matter is especially facilitated when the structure is of a type that can be assembled and disassembled without even the need of any tools whereby not only can it be erected without skilled labor, but even without any special tooling.

SUMMARY OF THE INVENTION

Accordingly, it is an object of the present invention to provide a quick assembly and knockdown building structure which can be easily erected without the use of any tools.

A further object of the present invention is to provide a building structure which can be easily erected and easily knocked down without the requirement of excessive time, labor, or cost.

Another object of the present invention is to provide a kit for use in the quick assembly of a building structure without the need of any tools.

Yet a further object of the present invention is to provide a quick assembly and knockdown building structure which can be erected in any shape desired by means of utilizing the same interchangeable parts.

A further object of the present invention is to provide a quick assembly and knockdown building structure whose parts can be installed in either of two inverted positions so as to avoid the necessity of specific orientation of particular parts of the assembly.

Briefly, in accordance with the present invention, there is provided a quick assembly and knockdown building structure. The structure is formed of a number of interconnected wall panels. Each of the wall panels has lateral sides. Projecting from one side is one part of an interlocking assembly. Projecting from the other side is the mating part of the interlocking member. Each of the panels are constructed substantially identical. In this manner, one part of the interlocking assembly on one panel can be interconnected to the mating part of the interlocking assembly onto the next adjacent panel.

There are also provided elongated corner posts for assembly of adjacent wall panels meeting at a corner of the structure. The corner posts have adjacent side walls on one of which is provided one part of the interlocking assembly, and on the adjacent side wall is provided the mating part of the interlocking member. In this manner, the corner post can be used to interconnect adjacent wall panels meeting at a corner of the structure and thereby provide a secure corner.

The interlocking assembly is of a type which include an L-shaped lip projecting from each side of the panels and the side walls of the corner posts. One part of the interlocking assembly has its L-shaped lip facing inwardly of the structure, and the other part of the interlocking assembly has its L-shaped lip facing outwardly. In this manner, the opposingly directed L-shaped lips can interfit in overlapping relationship and hook onto each other.

For ease of assembly, the L-shaped lip pointing rearwardly also includes a C-shaped seat portion for receiving the inwardly directed L-shaped lip of the other part so as to retain it in place. There are also provided stabilizing flanges projecting from the side wall panel at its edges so as to abut adjacent stabilizing flanges. For additional security, a locking sleeve can be slid onto the abutting stabilizing flanges to secure lateral wall panels in position adjacent to each other.

A sliding door panel can be utilized in place of one of the wall panels. The door panel can also include the same type of interlocking members along its opposing sides to interfit into the building structure just as a typical wall panel. Likewise, one of the wall panels can include a window and can be inserted in place of one of the standard wall panels.

All of the wall panels, corner posts, and even the door panel, can be constructed in a symmetrical arrangement about a horizontal axis therethrough. This will permit utilization of these members in any of its two inverted positions so as to avoid the necessity of requiring unique orientation of the structure members.

The aforementioned objects, features and advantages of the invention will, in part, be pointed out with particularity, and will, in part, become obvious from the following more detailed description of the invention taken in conjunction with the accompanying drawing, which forms an integral part thereof.

BRIEF DESCRIPTION OF THE DRAWING

In the drawing.

In the various figures of the drawing, like reference characters designate like parts.

DESCRIPTION OF THE PREFERRED EMBODIMENT

Figure 1:
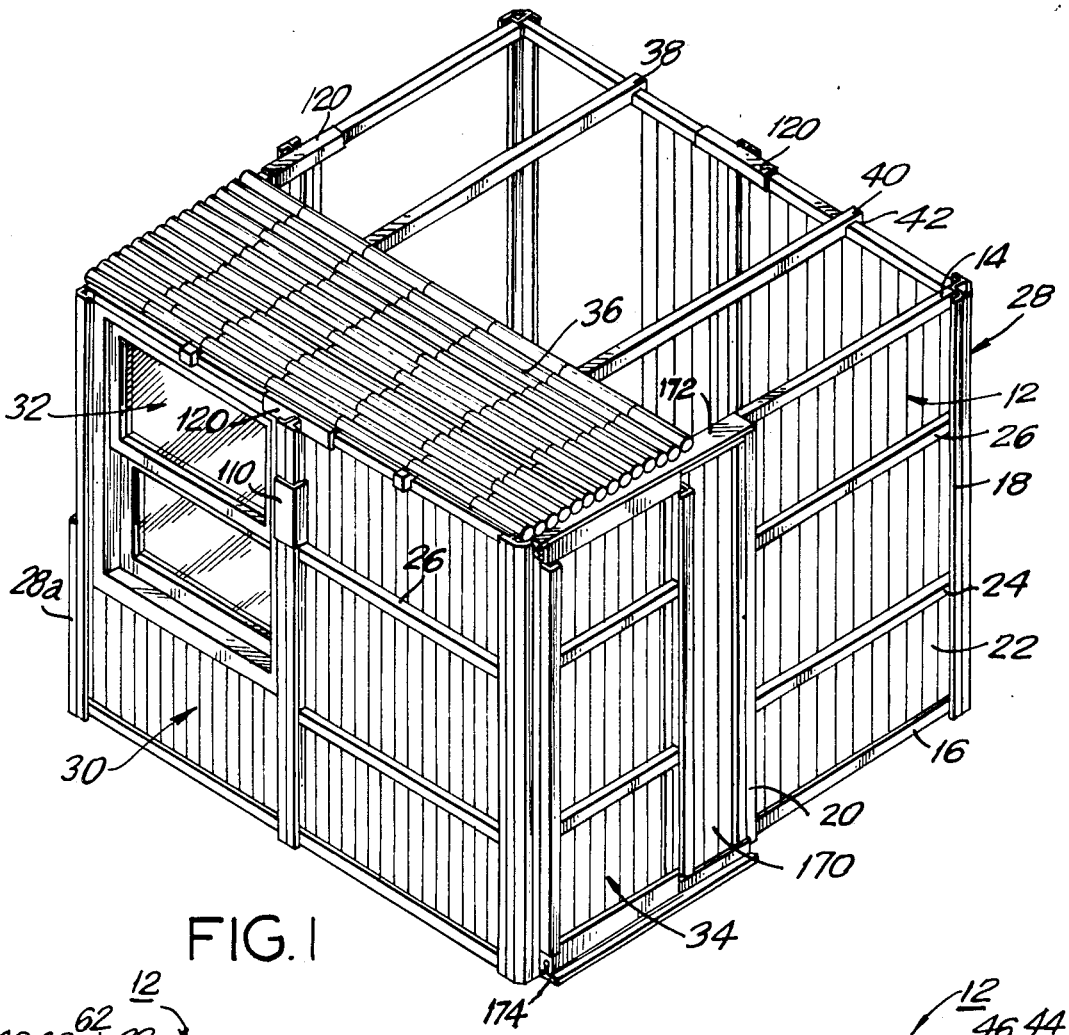
FIG. 1 is a perspective view of the building structure in the form of a Sukkah, and showing part of the roof uncovered.

Referring now to FIG. 1, there is shown the temporary building structure of the present invention as a Sukkah 10 formed of individual wall panels. Each of the wall panels 12 includes an upper frame 14 and a substantially identical lower frame 16, in the form of a U-shaped channel. The side frames 18, 20 are likewise substantially identical and in the form of U-shaped channels.

Contained within the frame can be any type of sturdy wall material. Typically, however, there is provided a corrugated fiber panel 22 which is formed of one section. The frame can include additional supporting ribs 24, 26 to provide extra rigidity. The ribs can be secured to the side frame members 18, 20 by rivets, and the like.

At each of the corners there is provided an elongated corner post 28 which interconnects adjacent panels meeting at the corner of the structure.

One of the panels, 30 includes a window 32. Wall panel 30 can be inserted in place of any of the other panels, as desired. There is also provided a door panel 34 which can substitute for any of the other wall panels throughout the structure wherever a door is desired.

Since the particular structure shown is utilized as a Sukkah, the roof is formed of adjacent bamboo rods 36 which would be placed across the entire roof. To support the bamboo rods 36 there are provided cross beams 38, 40. These can be formed of wood and laid across the wall panels. They could be notched at 42 to straddle the top frame of the wall panels and provide rigidity security to the structure to avoid shaking.

Figure 2A:
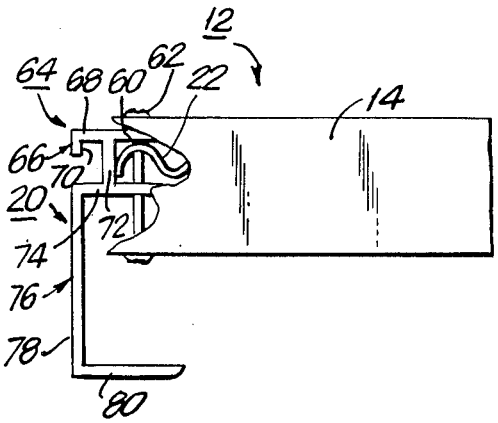
FIG. 2A is a top view partially broken away, of one end of the wall panel showing one part of the interlocking assembly.
Figure 2B:
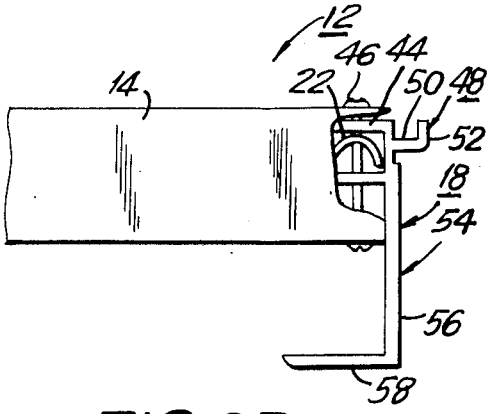
FIG. 2B is a top view partially broken away, of the opposing end of the wall panel showing the other part of the interlocking assembly.

With more particularity to FIGS. 2A and 2B, there is shown a typical wall panel 12 with its ends cut away to expose the side frame sections 18 and 20. Side frame 18 shown in FIG. 2B includes an internal U-shaped portion 44 which holds the wall 22. The U-shaped channel 44 is held in place by means of a rivet 46 which passes through the wall 22, as well as the upper U-shaped frame member 14.

Outwardly projecting from the lateral side of the frame section 18 is an L-shaped lip 48 froming one part of an interlocking assembly. The L-shaped lip includes the laterally projecting arm 50, and the inwardly projecting finger 52. Extending outwardly toward the front of the panel 12 is a stabilizing L-shaped flange 54 including the projecting leg 56 and the shorter front facing leg 58.

At the opposing lateral side of the same wall panel 12, is the other frame section 20. This frame section includes a U-shaped channel 60 on its interior which can hold the opposing end of the wall 22 by means of a rivet 62 which passes through the wall 22 and the upper frame 14. Laterally projecting from frame 20 section is the other mating part 64 of the interlocking assembly. The mating part 64 includes an L-shaped lip 66 having a projecting leg 68 and an outwardly extending finger 70. The L-shaped lip 66 forms part of an overall C-shaped seat whose light portion 72 extends along the side of the wall panel 12 and includes an opposing retaining leg 74.

Forwardly projecting from frame section 20 is an L-shaped stabilizing flange 76 including a forwardly directed leg portion 78 and a perpendicular facing leg 80.

Figure 3:
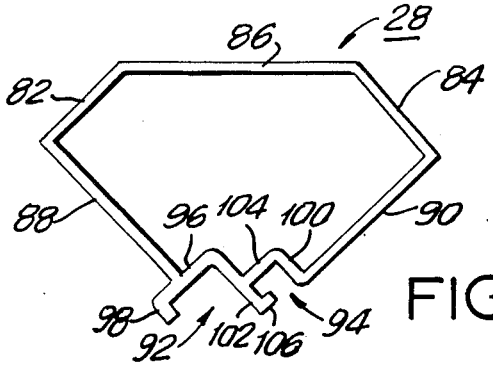
FIG. 3 is a top view of the corner post showing the presence of both parts of the interlocking assembly in substantially perpendicular arrangement.

Referring now to FIG. 3, there is shown a top view of a corner post 28. The exterior of the corner post includes a pair of exterior side walls 82, 84 and an interconnecting exterior wall 86. The interior portion of the corner post fits between adjacent wall panels meeting at the corner of the structure and include interior walls 88, 90. It should be appreciated that the walls 88, 90 are formed substantially perpendicular to each other in order to produce a right angle at the corner of the structure. However, any other angle can be used as in order to provide a desired angled corner of the structure that is needed. The structure could also be formed in a round shape by having the wall panels arcuate in shape and appropriately angled corners.

At the junction between the interior walls 88, 90 of the corner post 28, there is provided both part of an interlocking assembly. Specifically, the interlocking part 92 is similar to the interlocking part 48 shown in FIG. 2B. Interlocking part 94 on corner post in FIG. 3 is similar to interlocking part 64 shown in FIG. 2A.

Interlocking part 92 includes a substantially L-shaped lip including a projecting leg 96 and an inwardly turned finger 98. Interlocking part 94 includes a C-shaped seat including opposing legs 100, 102 with an interconnecting leg 104. At the end of leg 102 is the inwardly turned finger 106.

It should be appreciated that the two parts of the interlocking assembly fit into each other in an overlapping, interfitting relationship with one of the projecting fingers overlying the other projecting finger. Hereinafter, in order to facilitate description of the interlocking assembly, the interlocking part 48 on the wall panels, which is similar to the interlocking part 92 at the corner posts, will be referred to as the male portion of the interlocking assembly, while the part 64 on the wall panels corresponding to the part 94 at the corner posts, will be referred to as the female portion of the interlocking assembly. In connecting either panels to panels, or panels to a corner post, all that is needed is to mate a female portion of the interlocking assembly with a male portion.

Figure 10:
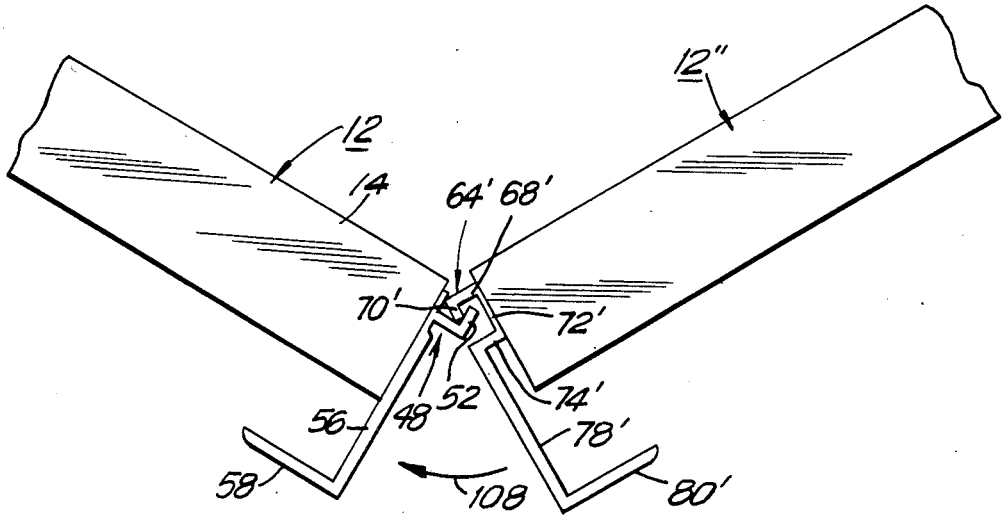
FIG. 10 is a top view showing a first step in the interconnection of laterally adjacent wall panels.

More specifically, with reference now to FIG. 10–12, there will be described the connection of one wall panel to another wall panel. As shown in FIG. 10, one wall panel 12 is being assembled to an adjacent wall panel 12'. In this case, the male portion 48 at the lateral end of panel 12 is connected to the female portion 64' at the left side of the panel 12'. In connecting the two wall panels, the panels are angularly oriented with respect to each other so that the finger 52 of the male portion 48 of the interlocking assembly can enter into the C-shaped seat of the female portion 64' of the interlocking assembly. The finger 52 enters beneath the finger 70'.

Figure 11:
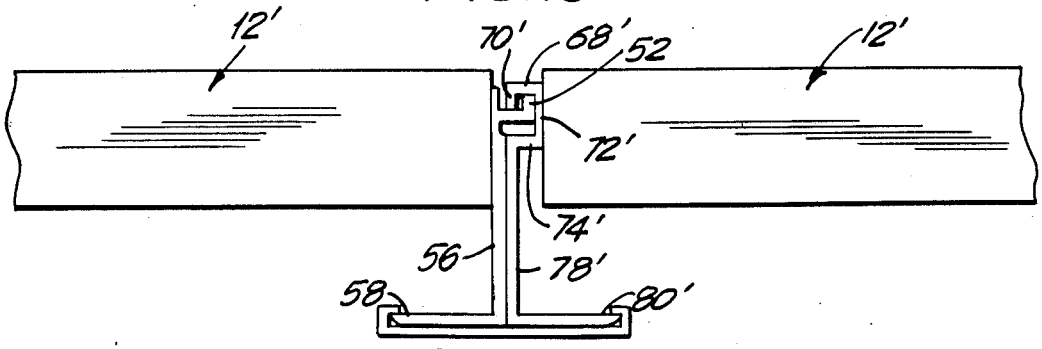
FIG. 11 is a view similar to that shown in FIG. 10 and showing the next step in the assembly of adjacent wall panels, with the wall panels being swung into a co-planar position.

As shown in FIG. 11, after the male portion has entered into the female portion of the assembly, the two panels are swung together as shown by the arrow 108 in FIG. 10 to align the two wall panesl 12, 12' in co-planar relationship. In so doing, the two stabilizing walls 56, 78' are brought into an abutting position and the two facing flange walls 58, 80' are co-planar. The abutment of the stabilizing legs 56, 78' serves as a limiting stop to the swinging together of the two panels and insures that they will be aligned in a single plane. A locking sleeve 110 is placed over the abuting legs.

Figure 12:
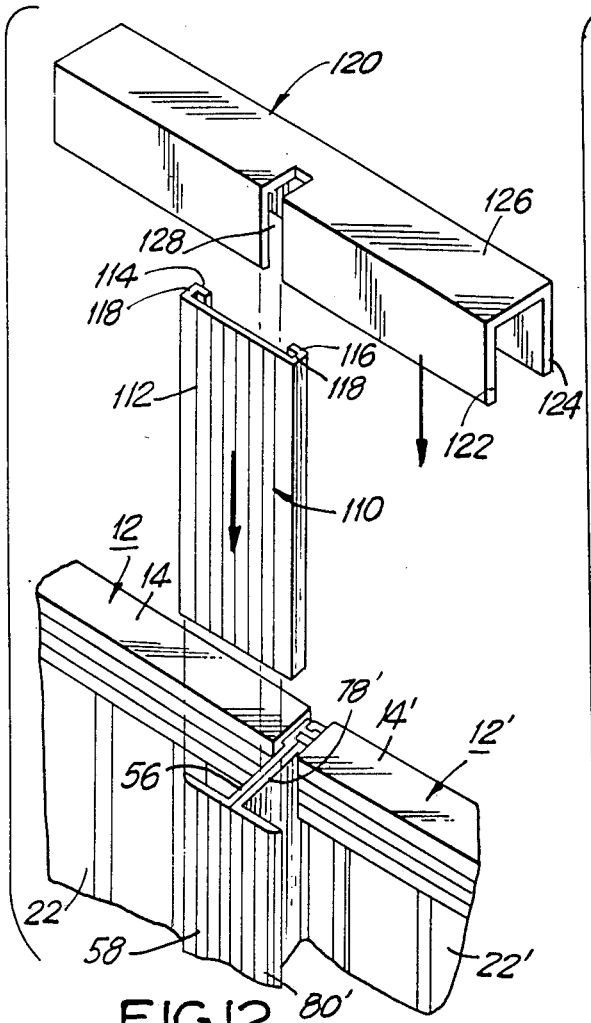
FIG. 12 is a perspective view showing the final step in the assembly of adjacent wall panels and by locking the panels together by means of a sleeve and a U-shaped channel brace.

As shown in FIG. 12, in order to lock the assembly of the two wall panels in place, a locking member shown as the sleeve member 110 can slide down over the co-planar facing legs 58, 80'. Sleeve 110 includes a flat front face 112 with inwardly bent distal ends 114, 116 to define a channel 118 between the inwardly turned ends 114, 116 and the front facing wall 112. The width of the front facing wall 112 approximates the combined width of the facing legs 58, 80'. With the sleeve slid in place, the two stabilizing legs 56, 78' will be held in place which correspondingly retains the wall panels co-aligned.

As can be noted in FIG. 1, the cross rib 26 serves as a stop for sliding of the sleeve 110 so that the sleeve will remain secured in place and not slide all the way to the bottom. Referring again to FIG. 12, as additional securement of the adjacent wall panel assembly, an inverted U-shaped channel 120 can be used as a saddle over the tops of the adjacent wall panels straddling across the interconnected portion. More specifically, the U-shaped locking channel 120 includes sidewalls 122, 124 with an interconnecting upper wall 126. The width of the connecting wall 126 proximates the width of the top frames 14, 14' of the wall panels. A notch 128 extends into the front wall 122 and partially across the top wall 126 of the channel 120 to accomodate the abutting stabilizing legs 56, 78' and to retain the locking U-shaped channel 120 in place. The U-shaped channel 120 therefore retains the walls in alignment and at the same time the stabilizing legs 56, 78' retains the channel in place. In addition to placing a channel 120 on the top frame, if desired, a similar channel could be placed at the bottom beneath the lower frame portion 16 of the adjacent wall panels.

Figure 4:
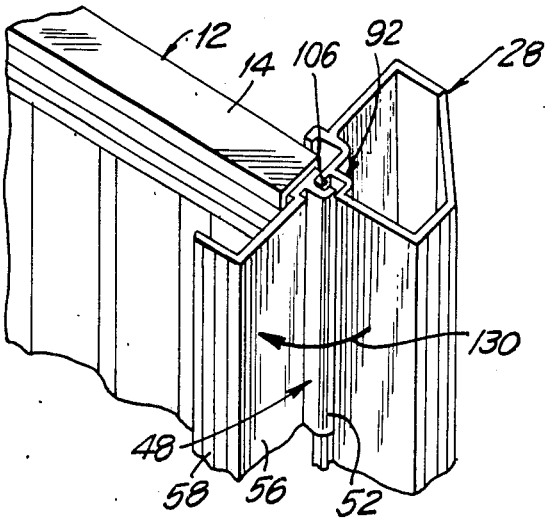
FIG. 4 is a perspective view showing a first step in the assembly of a corner post to a wall panel.

Referring now to FIG. 4, there is shown a first step in assembling a corner of the structure. A first wall panel 12 is hooked into the corner post 28 by means of the interlocking assembly. Depending upon the positioning of the structure, the corner post can be used either for first interconnecting a male or female portion since the corner assembly includes both a female and male portion of the interlocking assembly. As shown, wall panel 12 has its male portion 48 projecting from its side and, correspondingly, the female portion 92 of the corner post 28 will be utilized to mate with the wall panel.

Figure 5:
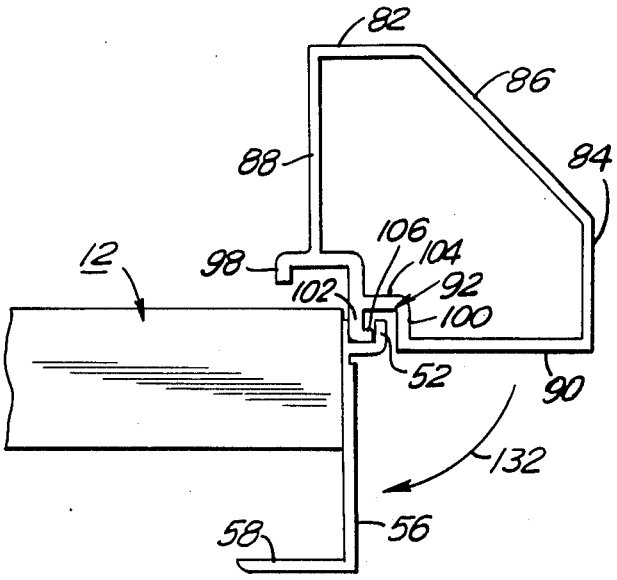
FIG. 5 is a top view of FIG. 4.

The projecting finger 52 of the male portion 48 is placed into the C-shaped seat of the female portion 92 to engage beneath the finger 98 of the female portion. With the male and female portions engaged, the corner post is swung as shown by the arrows 130, 132 in FIGS. 4 and 5 so that the interior wall 90 of the corner post abuts the stabilizing leg 56.

Figure 6:
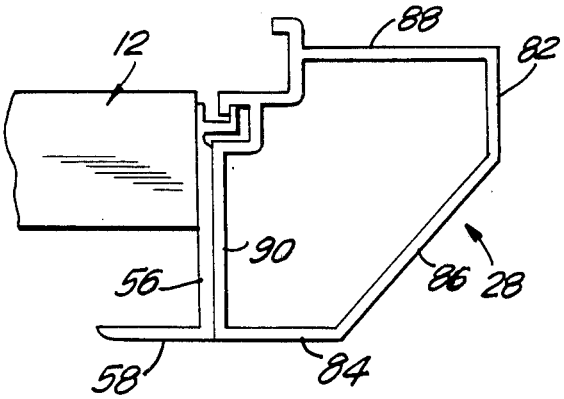
FIG. 6 is a view similar to that shown in FIG. 5 and showing the next step in the assembly, whereby the corner post has been swung adjacent to the wall panel.

As best shown in FIG. 6, the width of the interior wall 90 of the corner post corresponds to the width of the stabilizing leg 56 on the wall panel so the exterior wall 84 will form a continuation of the facing leg 58 of the wall panel. This makes a smooth continuous exterior corner of the structure.

Figure 7:
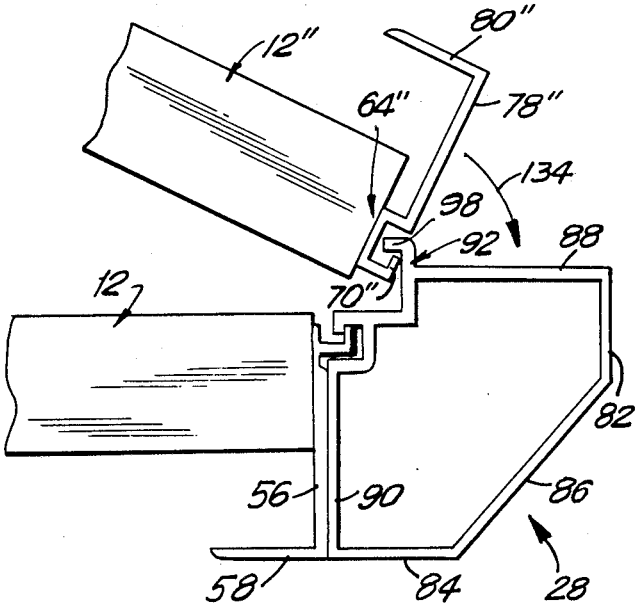
FIG. 7 is a view similar to that shown in FIG. 6 and now showing the next step in the interconnection of another wall panel meeting at the corner of the building structure.
Figure 8:
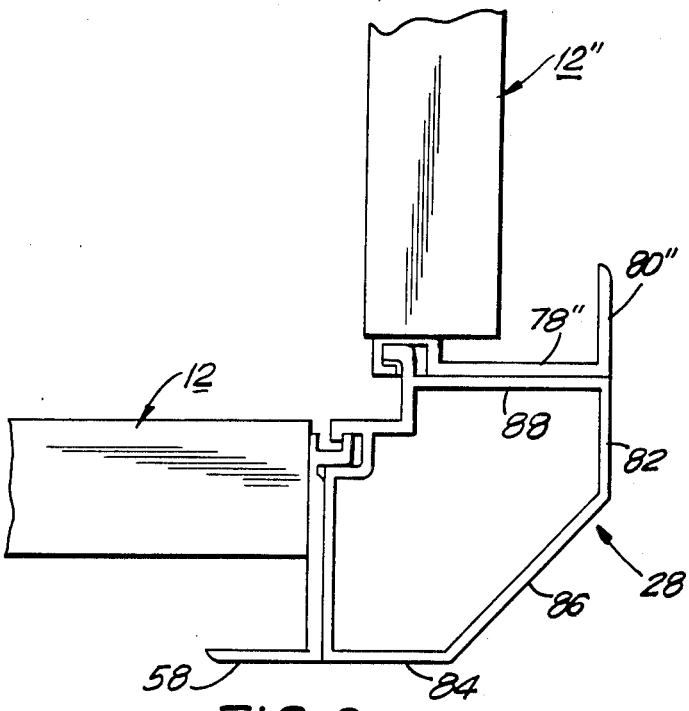
FIG. 8 is a top view similar to that shown in FIG. 7 and now showing both adjacent wall panels assembled to the corner post at a corner of the structure.

As shown in FIG. 7, the next wall panel 12" meeting at the corner will now be connected. In this case, the female portion 64" will engage with the male portion 92 on the corner post 28. The wall panel 12" is placed so that the finger 98 on the male portion enters into the C-shaped seat of the female portion 64" with the finger 98 engaging the finger 70". The wall panel 12" is then swung in place as shown by the arrow 134 to form the completed corner assembly as shown in FIG. 8.

The width of interior wall 88 of the corner post corresponds to the width of stabilizing leg 78" of wall panel 12". The front facing leg 80" will be a continuation of the wall 82 of the corner post. As FIG. 8 shows, the exterior corner provides a smooth continuous end between the facing leg 58, continuing to the exterior walls 84, 80 and 82 of the corner post and into the facing leg 80" of the wall panel 12".

When assembling a structure having four sides, when the last corner is reached, the adjacent wall panels are already in place and it is no longer feasible to swing the wall sections into a corner post. In order to assemble the final corner, the final corner post can be made into two or more short sections. Rather than swinging the wall panels in place with respect to the corner post, the corner post section can be aligned over the top of the male and the female interlocking portions already in place, and the corner post sections can be slid down in place.

Figure 9:
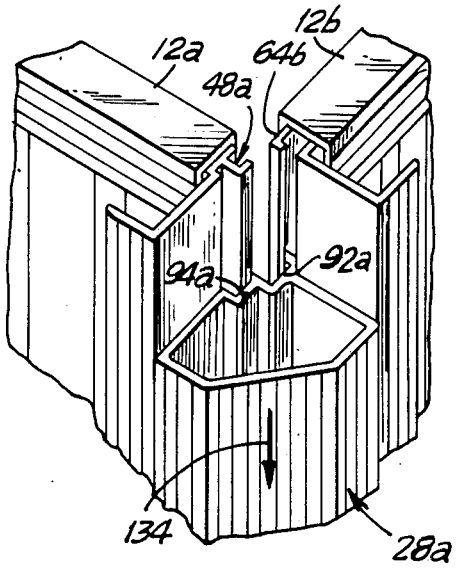
FIG. 9 is a perspective view showing the assembly of the corner post at the last corner of the building structure.

As shown in FIG. 9, the final corner include wall panels 12*a* and 12*b*. In this case, a male interlocking portion 48*a* projects from the wall panel 12*a* and a female interlocking portion 64*b* projects from the wall panel 12*b*. Since the wall panels 12*a* and 12*b* are already positioned, they can no longer be swung with respect to the corner post 28*a*. The corner post is aligned so that its female portion 94*a* is on top of the male portion 48*a* and its male portion 92*a* is on top of the female portion 64*b* and then is slid down in place as shown by the arrow 134. As noted in FIG. 1, on the left hand side is a short corner post section 28*a* which has been slid in place. The upper half of the corner post can be likewise slid into place so that a full corner post is provided even at the fourth corner.

Figure 13:
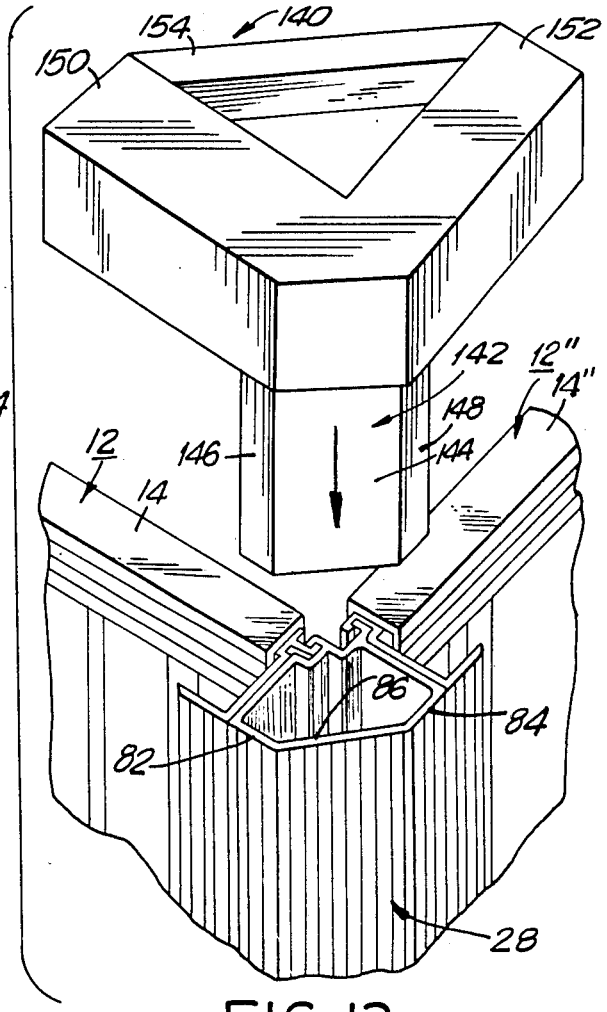
FIG. 13 is a perspective exploded view showing a plug member for locking the wall panels at a corner of the building structure.

In order to provide a greater locking at the corner assembly, a locking plug can be utilized, as shown in FIG. 13. The locking plug 140 includes a downwardly projecting plug 142 corresponding to the interior portion of the corner post 28. More specifically, it includes the rear wall 144, and side walls 146, 148 which correspond to the exterior walls 82, 84 and 86 of the corner post 28. The interior wall of the plug 142 would be correspondingly shaped to the plug, although it need not include the specific details around the interlocking portion and can be truncated at that point.

At the upper part of the locking plug 140 there is provided a pair of arms 150, 152 in the form of substantially inverted U-shaped channels which can overlie top frames 14, 14" of the adjacent wall panels 12, 12". A reinforcing interconnecting bar 154 is provided between the distal ends of the arms 150, 152.

The locking plug can be inserted at each of the corners in order to provide additional reinforcement at the corners. The angle of the corner plug will correspond to the particular angle provided at the corner post. Generally, for a four sided structure, this would be a perpendicular angle.

Figure 14:
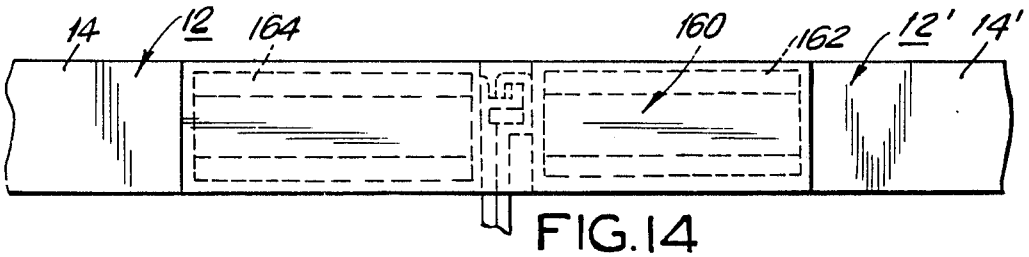
FIG. 14 is a top view showing an alternate embodiment of the locking together of adjacent co-planar wall panels.
Figure 15:
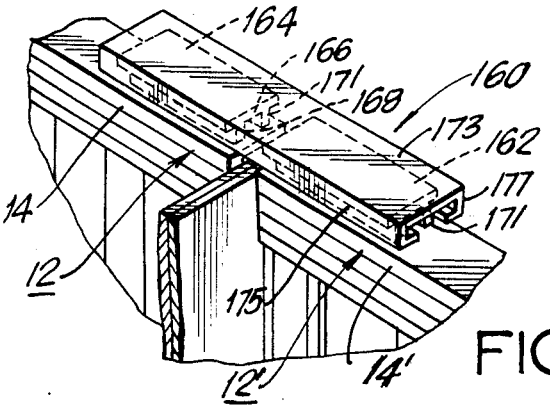
FIG. 15 is a perspective view of the locking arrangement of FIG. 14.

FIGS. 14 and 15 show an alternate type of interlocking assembly between adjacent wall panels. More specifically, between adjacent wall panels 12 and 12' there is utilized a sliding sleeve member 160 which slides over upwardly projecting T-shaped flanges 162, 164 on the upper frames 14, 14' of wall panels 12, 12'. The T-shaped flanges include a top wall 166 extending from supporting side walls 168, 171. The sleeve 160 can be similar to sleeve 110 shown in FIG. 12. It includes an upper wall 173 with a pair of inwardly directed arms 175, 177 which engage beneath an outwardly projecting lip at the distal end of the upper flange wall 66. The sleeve 160 would slide across the adjacent T-shaped flanges 162,164 and straddle the interconnection between the wall panels.

As shown in FIG. 1, a door panel can be used in place of one of the wall panels. The door panel is constructed equivalent in width to one of the wall panels whereby it can be substituted for any of the wall panels. The door panel includes a section 170 of wall with a side flange substantially identical to one of the slide flanges shown in FIGS. 2A and 2B. At the upper end and the lower end there are provided wider upper frame portions 172, 174. These can be identical whereby the door can be inverted just as any of the wall panels can be inverted and is symmetrical about its horizontal axis.

Figure 16:
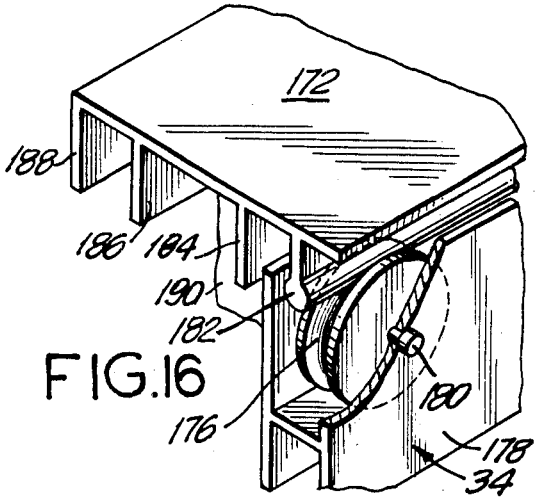
FIG. 16 is a perspective view showing the assembly of a door panel using a sliding door as part of a wall panel.

As shown in FIG. 16, the door 34 is a sliding door which includes a plurality of rollers 176 rotatably secured in the upper end of the door frame 178 by means of a rivet 180. The rollers can ride along a door track provided by a depending prong 182 from the upper frame 172. The upper frame 172 includes downward projecting arms 186 and 188 to retain the wall 170, and the arm 184 to retain the stabilizing flange at the end of the wall 170.

As can be appreciated, the door panel can be inserted using the same interconnecting assembly used on wall panels so it can be easily substituted where desired. In operation, the door slides open onto the wall section 170 and slides closed to close off the entire housing structure.

The window 32 can be substituted in place of any of the sections of the wall. It fits within the peripheral flanges so that the side flanges having the male and female portions are still present to permit interconnection into the structure in a similar manner to any other wall panel.

The frame itself including the upper and lower portions and especially the side frames including the male and female interconnecting parts can be of extruded aluminum. Any type of wall panels can be utilized although corrugated fiber panels provide for lightweight and sturdy construction. The structure can be assembled without the need of any tools or any fasteners such as nails, screws, or the like. Furthermore, it is easily assembled and easily knocked down. The structure is expandable so that at any time additional wall panels can be added. The particular periphery can be modified as desired in order to meet the required spacing availability. Each of the panels can be used in either of its inverted positions to facilitate assembly. Nevertheless, because of the male/female interconnection, it avoids the possibility of a wrong interconnection. When disassembled, the structure itself can be easily stored since it only includes flat wall panels and corner posts, in addition to the small locking sleeves as heretofore described.

There has been disclosed heretofore the best embodiment of the invention presently contemplated. However, it is to be understood that various changes and modifications may be made thereto without departing from the spirit of the invention.

What is claimed is:

1. A quick assembly and knockdown building structure comprising a plurality of wall panels, each wall panel, including lateral ends, with a male interlocking member along one lateral end and a mating female interlocking member along the opposing lateral end, the male interlocking member of one wall panel releasably interconnecting into the female interlocking member of the next adjacent wall panel, wherein one of said male and female interlocking members includes one laterally extending arm with an inwardly directed finger and the mating interlocking member includes another laterally extending arm with an outwardly directed finger and an outwardly spaced apart laterally extending retaining arm, the fingers of the mating interlocking members interfitting in overlapping relationship with the one laterally extending arm being positioned between said another laterally extending arm and said laterally extended retaining arm, whereby when adjacent wall panels are interconnected, they are both held vertically and one will not fall away from the other wall panel, wherein said interlocking members include abutment means for retaining adjacent wall panels in a planar relationship, and wherein the adjacent side of said corner posts are angularly related to provide the desired corner angle to the structure and wherein said corner posts are hollow, and further comprising a corner locking member including a plug insertable into the corner posts and a pair of perpendicular substantially inverted U-shaped arms extending from the plug for saddling onto the tops of the wall panels meeting at the corner of the structure.

2. A building structure as in claim 1, and further comprising elongated corner posts having adjacent side walls with a male interlocking member at one side wall and a mating female interlocking member at the other side wall, for releaseably interconnecting adjacent wall panels at a corner of the building structure.

3. A building structure as in claim 1, wherein said male interlocking member comprises an L-shaped flange in cross section with one arm laterally extending from one lateral end of a wall panel, and the other arm inwardly directed, and said female interlocking member comprises a C-shaped seat in cross section with a connecting bracket arm adjacent the opposite lateral end of the wall panel and an inner laterally oriented arm including an outwardly directed lip for overlapping engagement with the inwardly directed leg of the male interlocking member and an outer laterally oriented arm, said inwardly directed arm being received within the interior of the C-shaped seat between said inner and outer oriented arms.

4. A building structure as in claim 1, and further comprising an outwardly directed stabilizing wall projecting from each lateral edge of the wall panels, the stabilizing walls of adjacent wall panels abutting each other in their interconnected position.

5. A building structure as in claim 4, and further comprising locking means for securing the abutting stabilizing walls of adjacent wall panels.

6. A building structure as in claim 5, wherein said stabilizing walls include a flange wall perpendicularly extending from the distal end of the stabilizing wall, the flange walls of adjacent interconnected wall panels being co-planar, and wherein said locking means comprises a sleeve having a planar front wall and a pair of inwardly directed arms extending from the distal ends of the front wall, said sleeve being slideable onto said flange walls for securing the adjacent wall panels in this interconnected condition.

7. A building assembly as in claim 6, wherein said wall panels comprise transverse support ribs, said ribs also providing a sliding stop for the sleeve.

8. A building structure as in claim 5, wherein said locking means comprise an elongated U-shaped channel for saddling the tops of interconnected adjacent wall panels, and including a notched portion there along for accommodating the abutting stabilizing walls for retaining them in abuting relationship.

9. A building structure as in claim 1, wherein said interlocking members comprise an outwardly directed stabilizing wall projecting from each lateral edge of the wall panel, said sidewalls of said corner posts abutting the stabilizing walls of the wall panels meeting at the corner of the structure.

10. A building structure as in claim 9, wherein the stabilizing walls include a flange wall perpendicularly extending from the distal end of the stabilizing wall, and wherein said corner posts comprise an outer periphery for continuing the flange walls of the wall panels meeting at the corner of the structure, and forming a smooth truncated corner.

11. A building structure as in claim 1, and further comprising a door panel for substitution of a wall panel, said door panel having a verticle wall panel section on one side and a sliding door on the other side, said sliding door slideable onto the wall panel section in an open position, said door panel comprising lateral ends with a male interlocking member along one lateral end and a mating female interlocking member along the opposing lateral end.

12. A building structure as in claim 1, wherein said panels are symmetrical about a horizontal axis thereacross so as to be usable in either of its inverted positions.

13. A quick assembly and knockdown building structure comprising a plurality of wall panels, each wall panel including lateral ends with a male interlocking member along one lateral end and a mating female interlocking member along the opposing lateral end, the male interlocking member of one wall panel releasably interconnecting into the female interlocking member of the next adjacent wall panel, wherein one of said male and female interlocking members includes a laterally extending arm with an inwardly directed finger and the mating interlocking member includes a laterally extending arm with an outwardly directed finger, the fingers of mating interlocking members interfitting in overlapping relationship, and further comprising an outwardly directed stabilizing wall projecting from each lateral edge of the wall panels, the stabilizing walls of adjacent wall panels abutting each other in their interconnected position, and further comprising locking means for securing the abutting stabilizing walls of adjacent wall panels, wherein said locking means comprise locking tabs upwardly projecting from the top of the wall panels and a sleeve member for sliding onto the locking tabs and straddling adjacent interconnected wall panels.

* * * * *